US006237179B1

(12) United States Patent
Balceiro

(10) Patent No.: US 6,237,179 B1
(45) Date of Patent: May 29, 2001

(54) BRUSH ATTACHMENT FOR A RECIPROCATING SAW

(76) Inventor: Enrique S. Balceiro, 750 SE. 6th Pl., Hialeah, FL (US) 33010

( * ) Notice: Subject to any disclaimer, the term of this patent is extended or adjusted under 35 U.S.C. 154(b) by 0 days.

(21) Appl. No.: 09/390,754

(22) Filed: Sep. 7, 1999

(51) Int. Cl.[7] ..... A46B 9/00; A46B 13/02
(52) U.S. Cl. ..... 15/22.2; 15/22.1
(58) Field of Search ..... 15/22.1, 22.2, 15/23; 451/904

(56) References Cited

U.S. PATENT DOCUMENTS

| | | | | |
|---|---|---|---|---|
| 1,693,964 | * | 12/1928 | Smith | 15/23 |
| 3,181,280 | * | 5/1965 | Bubelis | 15/23 |
| 3,903,657 | | 9/1975 | Pfister . | |
| 3,914,906 | | 10/1975 | Barnes . | |
| 3,950,896 | | 4/1976 | Ozero . | |
| 4,128,970 | | 12/1978 | Sawrenko . | |
| 4,238,867 | * | 12/1980 | Ruggero et al. | 15/23 |
| 4,397,055 | * | 8/1983 | Cuchiara | 15/23 |
| 4,707,947 | | 11/1987 | Harris . | |
| 4,893,437 | | 1/1990 | Doherty . | |
| 5,307,534 | * | 5/1994 | Miller | 15/23 |
| 5,353,461 | * | 10/1994 | Enriquez | 15/23 |
| 5,636,400 | * | 6/1997 | Young | 15/23 |
| 5,781,955 | * | 7/1998 | Hendricks | 15/22.1 |
| 6,120,363 | * | 9/2000 | Dunn | 15/22.2 |

* cited by examiner

*Primary Examiner*—Terrence R. Till
(74) *Attorney, Agent, or Firm*—Henderson & Sturm LLP

(57) ABSTRACT

A brush attachment for a reciprocating saw comprising a number of brushes including wire brushes, hard bristle brushes, etc. that are provided with an attachment shank that fits into the blade receiving chuck of a conventional reciprocating saw.

1 Claim, 1 Drawing Sheet

BRUSH ATTACHMENT FOR A RECIPROCATING SAW

BACKGROUND OF THE INVENTION

1. Field of the Invention

The present invention relates to the field of power tool attachments, and more particularly to a brush attachment for a reciprocating saw.

2. Description of the Related Art

As can be seen by reference to the following U.S. Pat. Nos. 3,903,657; 3,914,906; 3,950,896; 4,128,970; 4,707,947 and 4,893,437 the prior art is replete with myriad and diverse power tool attachments.

While all of the aforementioned prior art constructions are more than adequate for the basic purpose for which they have been specifically designed, they are uniformly deficient with respect to their failure to provide a simple, efficient and practical brush attachment for a reciprocating saw.

As a consequence of the foregoing situation, there has existed a need for a new and improved brush attachment for a reciprocating saw and the provision of such a construction is a stated objective of the present invention.

BRIEF SUMMARY OF THE INVENTION

Briefly stated, the present invention provides a brush attachment for a reciprocating saw comprising a number of brushes including wire brushes, hard bristle brushes, etc. that are provided with an attachment shank that fits into the blade receiving chuck of a conventional reciprocating saw.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
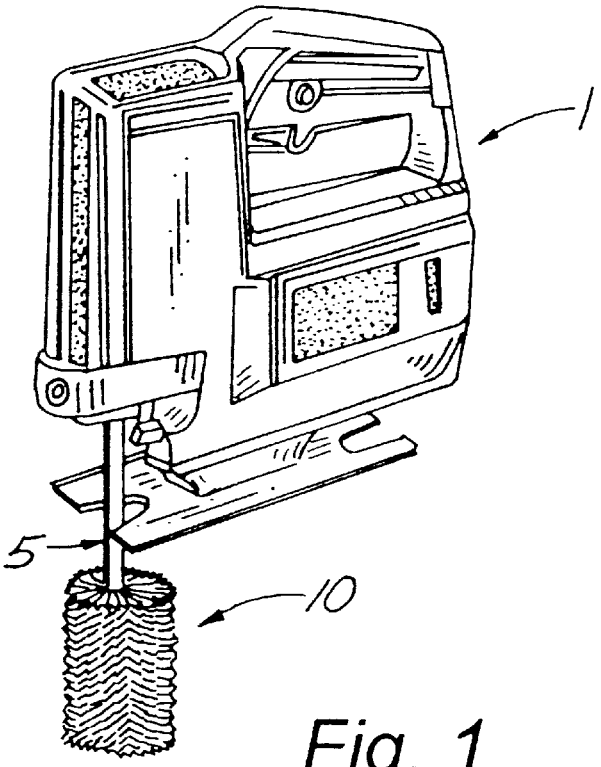
FIG. 1 is a perspective view of the brush attachment of the present invention secured to the chuck of a reciprocating saw.
Figure 2:
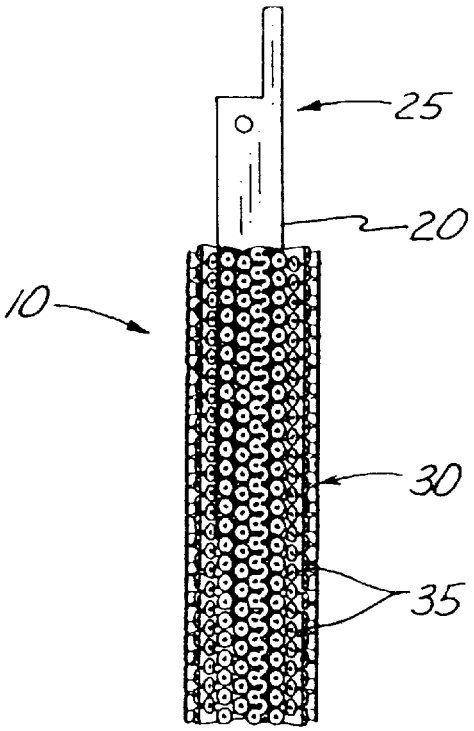
FIG. 2 is a side elevational view of the brush attachment.
Figure 3:
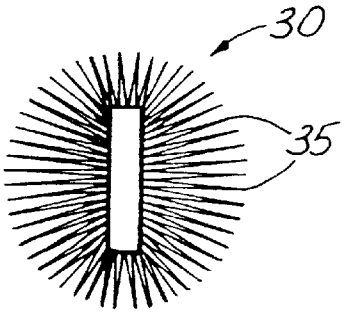
FIG. 3 is a bottom plan view of a brush attachment having a circular cross-sectional shape.
Figure 4:
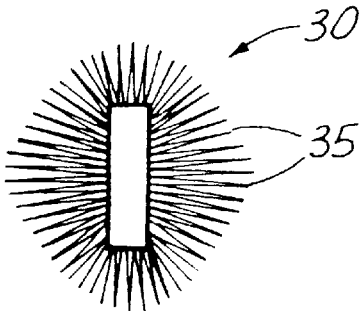
FIG. 4 is a bottom plan view of a brush attachment having a triangular cross-sectional shape.
Figure 5:
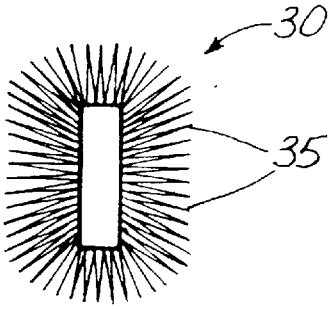
FIG. 5 is a bottom plan view of a brush attachment having a rectangular cross-sectional shape.

As can be seen by reference to the drawings, and in particulary to FIG. 1, the brush attachment that forms the basis of the present invention is designated generally by reference number (10). The brush attachment (10) fits into the chuck of any standard reciprocating saw (1) such as a jigsaw or a sawzall. The brush attachment (10) is used to clean or sand hard-to-reach areas in preparation for painting or welding. The up-and-down motion of the reciprocating saw (1) allows the brush attachment (10) to reach places not accessible with a circular brush or sander. The brush attachment (10) easily attaches to any standard reciprocating saw (1) in the same manner as a blade. The brush attachment includes a durable steel shank (20) that will not bend or break during cleaning or sanding. When cleaning or sanding is completed, the brush attachment (10) can be quickly removed and replaced with a regular saw blade. The brush attachment (10) may be manufactured in a nylon-bristled version for light cleaning, and a brass or steel-bristled version for heavier cleaning. The brush member (30) would also be available in different shapes such as circular (FIG. 3), diamond-shaped (FIG. 4), and rectangular (FIG. 5) to accommodate for and better reach specific areas to be cleaned or sanded.

The lower two-thirds of the shank (20) carries a nylon, brass, or steel-bristled brush member (30) that would be attached to a standard type reciprocating saw steel blade shank (20). The upper end (25) of the shank (20) is configured to attach to the saw chuck (5) of the saw as would any blade. The brush bristles (35) may be manufactured from various materials including nylon, brass, and both light and heavy steel, allowing the user to choose a material to accommodate the specific cleaning or sanding needs of the job at hand. The brush member (30) is also available in different brush shapes such as circular, diamond-shaped, and rectangular, which would allow the user to choose the appropriate brush shape for the area to be cleaned or sanded.

In use, the user simply attaches the brush attachment (10) to any standard reciprocating saw (1) in the same manner that a blade would be attached. A nylon-bristled version would be available for light cleaning, and a brass or steel-bristled version would be available for heavier cleaning. The variety of available brush shapes allows the user to select the appropriate shape for their specific cleaning or sanding needs. With its unique design, the brush attachment (10) can clean or sand any hard to reach areas in preparation for painting or welding. The brush attachment (10) may also be easily removed when cleaning is completed.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

I claim:

1. A brush attachment for a reciprocating saw having a blade receiving chuck, the brush attachment consisting of:

a shank having an upper end configured to be received in and secured by the chuck of the reciprocating saw, and a lower portion; and a brush member attached to and surrounding the lower portion of the shank and disposed to extend radially out from the shank, wherein the brush member is substantially rectangular in cross-sectional shape; and wherein the brush member surrounds about two-thirds of the shank.

* * * * *